US009234435B2

(12) United States Patent
Ayers

(10) Patent No.: US 9,234,435 B2
(45) Date of Patent: Jan. 12, 2016

(54) TIP-CONTROLLED INTEGRALLY BLADED ROTOR FOR GAS TURBINE

(71) Applicant: Pratt & Whitney Canada Corp., Longueuil (CA)

(72) Inventor: Alexandre Ayers, Toronto (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 451 days.

(21) Appl. No.: 13/792,994

(22) Filed: Mar. 11, 2013

(65) Prior Publication Data

US 2014/0250897 A1 Sep. 11, 2014

(51) Int. Cl.

| | |
|---|---|
| ***F01D 11/16*** | (2006.01) |
| ***F01D 11/22*** | (2006.01) |
| ***F01D 5/34*** | (2006.01) |

(52) U.S. Cl.

CPC *F01D 11/16* (2013.01); *F01D 5/34* (2013.01); *F01D 11/22* (2013.01); *F05D 2300/501* (2013.01)

(58) Field of Classification Search

CPC ..... F01D 11/14; F01D 11/16; F01D 11/20; F01D 11/22; F01D 5/34; F05D 2260/77; F04D 29/642

USPC ..... 415/173.1–173.3; 416/135

See application file for complete search history.

(56) References Cited

U.S. PATENT DOCUMENTS

| | | | | |
|---|---|---|---|---|
| 2,654,565 | A * | 10/1953 | Feilden | F01D 5/066 415/143 |
| 3,598,503 | A | 8/1971 | Muller | |
| 4,363,599 | A | 12/1982 | Cline et al. | |
| 5,688,107 | A | 11/1997 | Downs et al. | |
| 6,368,054 | B1 | 4/2002 | Lucas | |
| 7,125,223 | B2 | 10/2006 | Turnquist et al. | |
| 7,210,899 | B2 | 5/2007 | Wilson, Jr. | |
| 7,400,994 | B2 * | 7/2008 | Phipps | F01D 5/02 702/113 |
| 7,654,791 | B2 | 2/2010 | Werner | |
| 7,806,662 | B2 | 10/2010 | Gekht et al. | |
| 8,186,961 | B2 | 5/2012 | Stone | |
| 8,408,446 | B1 * | 4/2013 | Smoke | B23P 15/006 228/193 |
| 8,932,012 | B2 * | 1/2015 | Wlasowski | F01D 5/063 415/199.4 |

* cited by examiner

*Primary Examiner* — Thomas Denion
*Assistant Examiner* — Laert Dounis
(74) *Attorney, Agent, or Firm* — Norton Rose Fulbright Canada LLP

(57) ABSTRACT

An integrally bladed rotor for a gas turbine engine includes a hub, a plurality of blades radially extending from the hub and being integrally formed therewith. The hub having a rim from which the blades project and a pair of axially opposed split hub members extending at least radially inward from the rim. Each of the split hub members has a radially outer flex arm portion extending form the hub and a radially inner moment flange portion. At least one moment inducing element separately formed from the hub is mounted axially between the opposed split hub members and acts on the moment flange portions of the opposed split hub members to generate an inward bending moment on the flex arm portions of the opposed split hub members during rotation of the rotor, thereby deflecting the rim and the blades of the rotor radially inwardly.

20 Claims, 5 Drawing Sheets

TIP-CONTROLLED INTEGRALLY BLADED ROTOR FOR GAS TURBINE

TECHNICAL FIELD

This disclosure relates generally to a gas turbine engine, and more particularly to an integrally-bladed rotor for such an engine.

BACKGROUND

One manner of minimizing blade tip leakage is to minimize the blade tip deflection, and thus the blade tip clearance, at engine running conditions. As such, there exist a number of both passive and active tip clearance control systems which strive to minimize and control blade tip clearance. Known passive systems used to control blade tip deflection include simply using the bore of the rotor to minimize blade tip deflections. For example, by simply adding more material to the bore, blade tip clearance can be minimized. The use of rotor bores is well suited to minimize blade tip deflections for rotors with large heavy blades, such as a fan. However, such known passive systems are much less effective at minimizing the blade tip deflections of lightweight blades used in axial compressors, particularly those high pressure compressor rotors located in the later axial stages of the compressor. Further, it is undesirable to add additional material, and therefore weight, to the hubs or bores of axial compressor rotors, particularly when the overall hub mass which results is less than is needed for minimum acceptable fatigue life. Known active tip clearance control systems tend to be relatively complex and also add weight to the rotors themselves and/or the fan or compressor stage within which they are employed.

According, an improved manner of minimizing and controlling blade tip clearance for axial rotors of gas turbine engines is sought.

SUMMARY

In one aspect there is provided an integrally bladed rotor for a gas turbine engine comprising: a hub defining a central axis of rotation about which the rotor is rotatable; a plurality of blades radially extending from the hub and being integrally formed therewith to define the integrally bladed rotor, the blades being adapted to project into an annular gas flow passage of said gas turbine engine; the hub having a rim from which said blades radially project and a pair of axially opposed split hub members extending at least radially inward from said rim, each of the split hub members having a radially outer flex arm portion extending form the hub and a radially inner moment flange portion integrally formed with the flex arm portion, a radial inner edge of the moment flange portions defining a central bore of the rotor; and at least one moment inducing element separately formed from the hub and mounted axially between the opposed split hub members, the moment inducing element acting on the moment flange portions of the opposed split hub members to generate an inward bending moment on the flex arm portions of the opposed split hub members during rotation of the rotor, thereby deflecting the rim and the blades of the rotor radially inwardly.

There is also provided a gas turbine engine including a fan, a compressor section, a combustor and a turbine section in serial flow communication and each defining an annular gas flow passage, the gas turbine engine comprising: at least one of the fan, the compressor section and the turbine section having at least one rotor, the rotor including a hub and a plurality of blades integrally formed therewith to define an integrally bladed rotor, the blades each extending radially outwardly from the hub to a remote blade tip and projecting into the annular gas flow passage of said at least one of the fan, the compressor section and the turbine section; a shroud circumferentially surround the rotor and having a radially inner surface adjacent to the blade tips, a radial distance between the inner surface of the shroud and the blade tips defining a tip clearance gap of the rotor; the hub of the rotor having a rim from which said blades radially project and a pair of axially opposed split hub members extending at least radially inward from said rim, each of the split hub members having a radially outer flex arm portion extending form the hub and a radially inner moment flange portion integrally formed with the flex arm portion, a radial inner edge of the moment flange portions defining a central bore of the rotor; and the rotor having at least one moment inducing element separately formed from the hub and mounted axially between the opposed split hub members, the moment inducing element acting on the moment flange portions of the opposed split hub members to generate an inward bending moment on the flex arm portions of the opposed split hub members during rotation of the rotor, thereby deflecting the rim and the blades of the rotor radially inwardly and minimizing the tip clearance gap between the blade tips and the shroud during operation of the gas turbine engine.

There is further provided a method of improving efficiency of a rotor for a gas turbine engine by minimizing a tip clearance gap between blade tips of the rotor and a surrounding outer shroud, the method comprising: providing the rotor with a hub and a plurality of blades which are integrally formed therewith to form an integrally bladed rotor, the blades extending radially outwardly from the hub to the blade tips and projecting into an annular gas flow passage of said gas turbine engine, the hub of the rotor having a rim from which said blades project and a pair of axially opposed split hub members extending at least radially inward from said rim, each of the split hub members having a radially outer flex arm portion extending form the hub and a radially inner moment flange portion integrally formed with the flex arm portion; and inducing an inward bending moment on the flex arm portions of the split hub members to deflect the rim and the blades of the rotor radially inwardly, thereby minimizing the tip clearance gap between the blade tips and the shroud during operation of the gas turbine engine.

Further details of these and other aspects of above concept will be apparent from the detailed description and drawings included below.

BRIEF DESCRIPTION OF THE DRAWINGS

Reference is now made to the accompanying drawings, in which.

DETAILED DESCRIPTION

Figure 1:
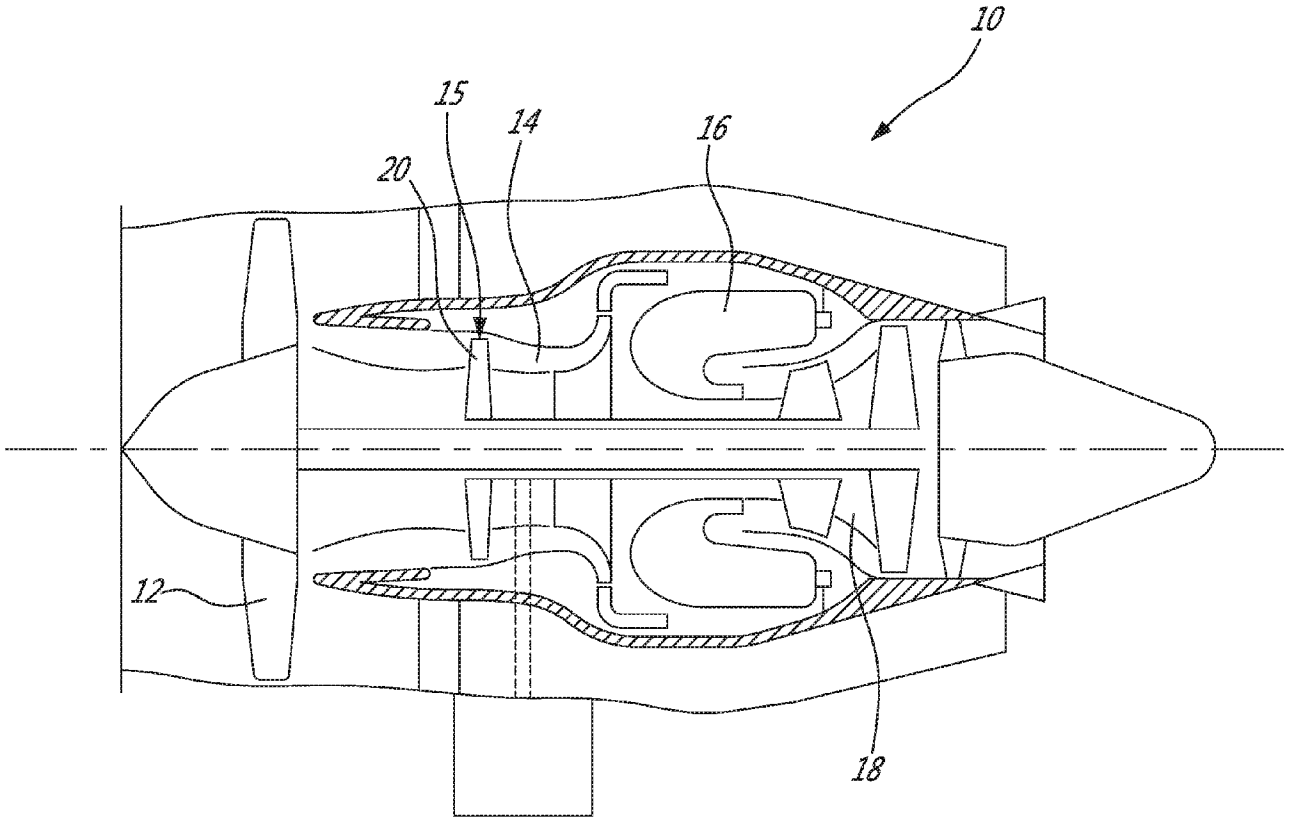
FIG. 1 is a schematic cross-sectional view of a turbofan gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. The multistage compressor section 14 includes at least one or more axial compressors, each having an axial rotor 20. Although a turbofan engine is depicted and described herein, it will be understood however that the gas turbine engine 10 may comprise other types of gas turbine engines such as a turbo-shaft, a turbo-prop, or auxiliary power units.

The compressor section 14 of the gas turbine engine 10 may be a multi-stage compressor, and thus may comprise several axial compressors 15, each having an axial rotor 20, which form consecutive stages of the compressor.

Figure 2:
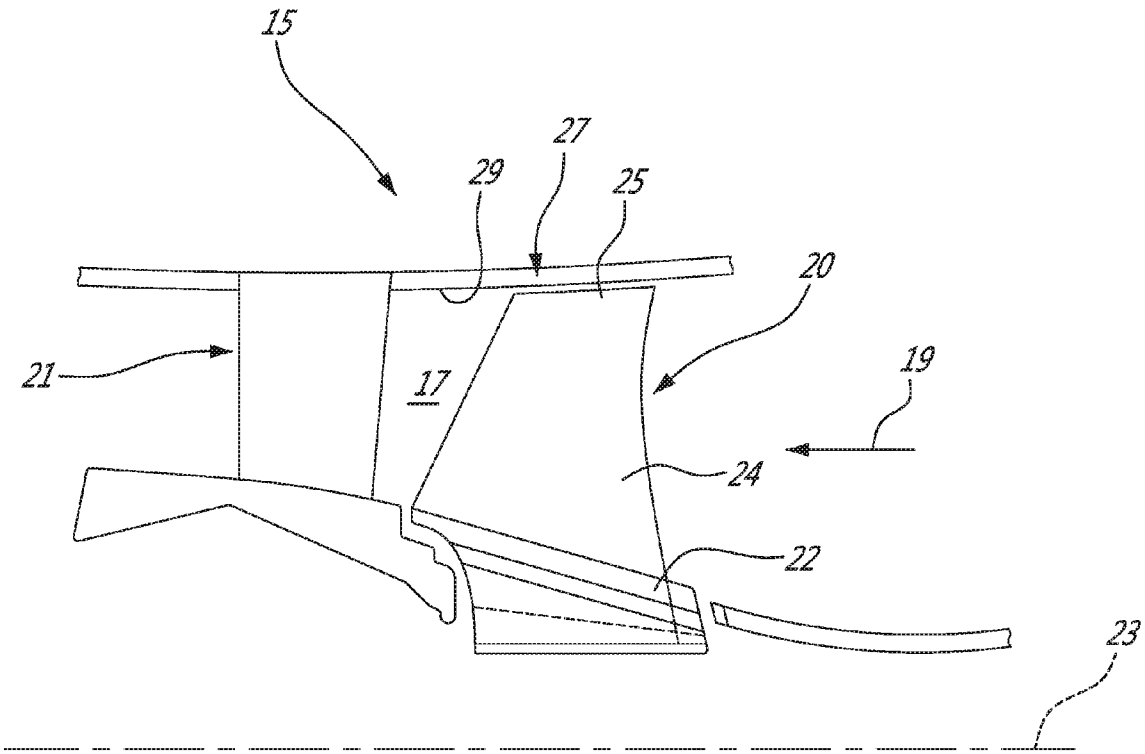
FIG. 2 is a partial cross-sectional view of an axial compressor of the gas turbine engine of FIG. 1.

Referring to FIG. 2, the axial compressor 15 of the compressor section 14 of the gas turbine engine 10 comprises generally a rotor 20 and a stator 21 downstream relative thereto, each having a plurality of blades defined within the gas flow path 17 which includes the compressor inlet passage upstream of the rotor 20 and the compressor discharge passage downstream of the stator 21. The gas flowing in direction 19 is accordingly fed to the axial compressor 15 via the compressor inlet passage of the gas path 17 and exits therefrom via the compressor discharge passage. The rotor 20 rotates about a central axis of rotation 23 within the stationary and circumferentially extending outer casing or shroud 27, the radially inwardly facing wall 29 of which defines a radial outer boundary of the annular gas flow path 17 through the compressor 15. As will be described in further detail below, the rotor 20 includes a central hub 22 and a plurality of blades 24 radially extending therefrom and terminating in blade tips 25 immediately adjacent the outer shroud 27.

Any one or more of the axial rotors 20 of the multi-stage compressor 14, as well as the axial rotor which forms the fan 12, may be integrally-bladed rotors (IBR). IBRs are formed of a unitary or monolithic construction, in that the radially projecting rotor blades thereof are integrally formed with the central hub. Although the present disclosure will focus on an axial compressor rotor that is an IBR, it is to be understood that the presently described configuration for minimizing and controlling blade tip clearance could be equally applied to impellors (i.e. centrifugal compressors) which are IBRs, to IBR fans 12, or to other rotors used in the compressor or turbine of an airborne gas turbine engine.

Figure 3:
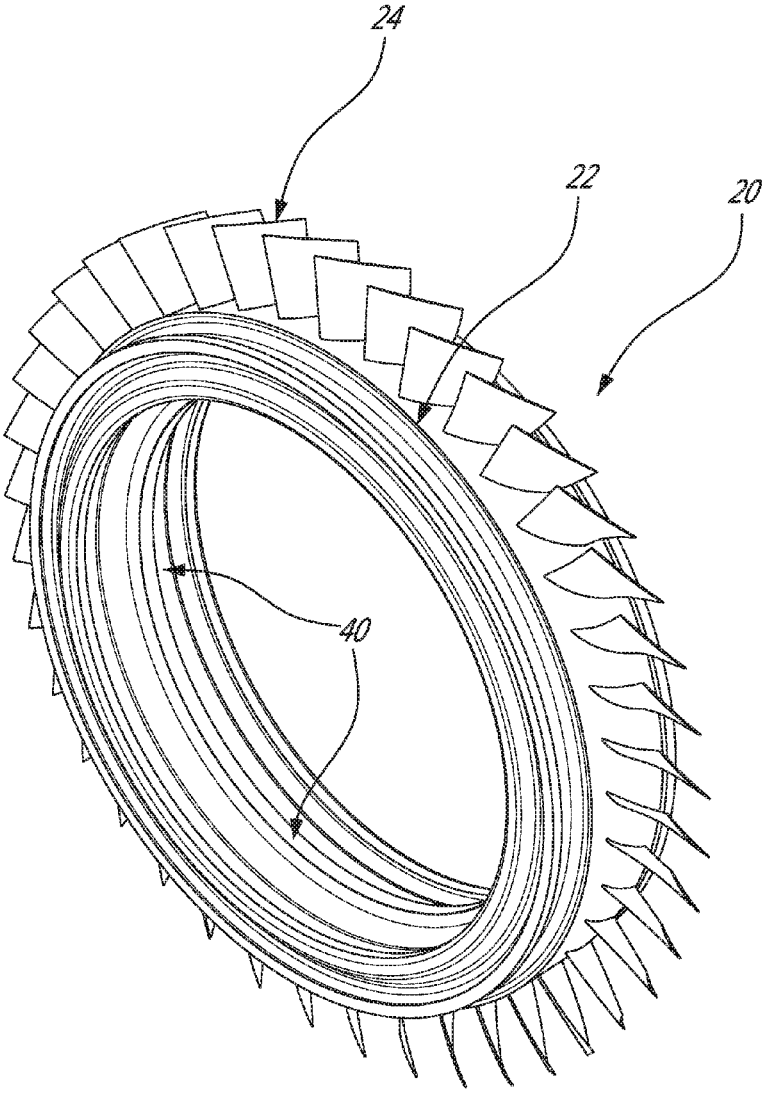
FIG. 3 is a perspective view of a rotor of the axial compressor of FIG. 2, shown in partial transparency for ease of explanation only.

Referring now to FIG. 3, the axial rotor 20 of the compressor 14 is an integrally-bladed rotor (IBR) which generally includes a central hub 22 and a plurality of radially extending blades 24 which are integrally formed with the hub 22. As will be seen in further detail below, the hub 22 has an internal cavity 28 which extends circumferentially about the hub and within which at least three loading plates 40 are disposed. The IBR 20 therefore includes an annular hub 22 and radially extending blades 24 which are integrally formed with the hub 22.

Figure 4:
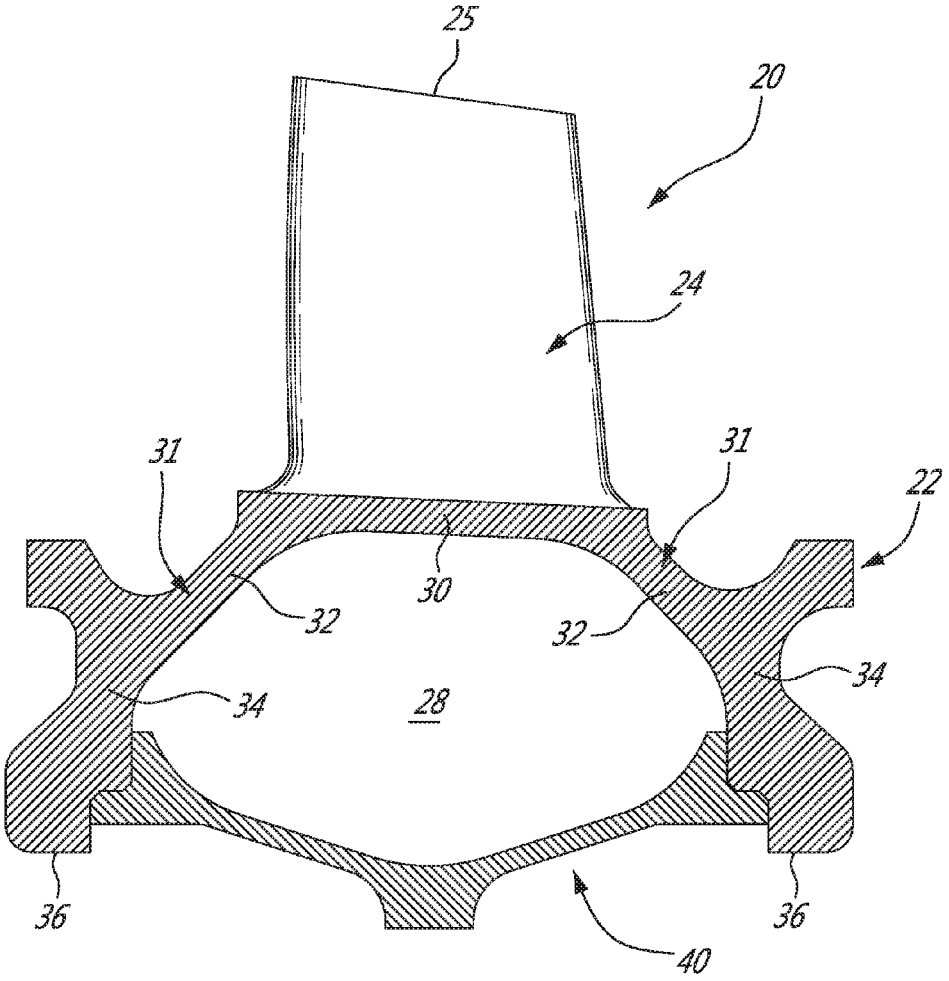
FIG. 4 is a cross-sectional view of the rotor of FIG. 2, including a loading plate thereof.
Figure 5:
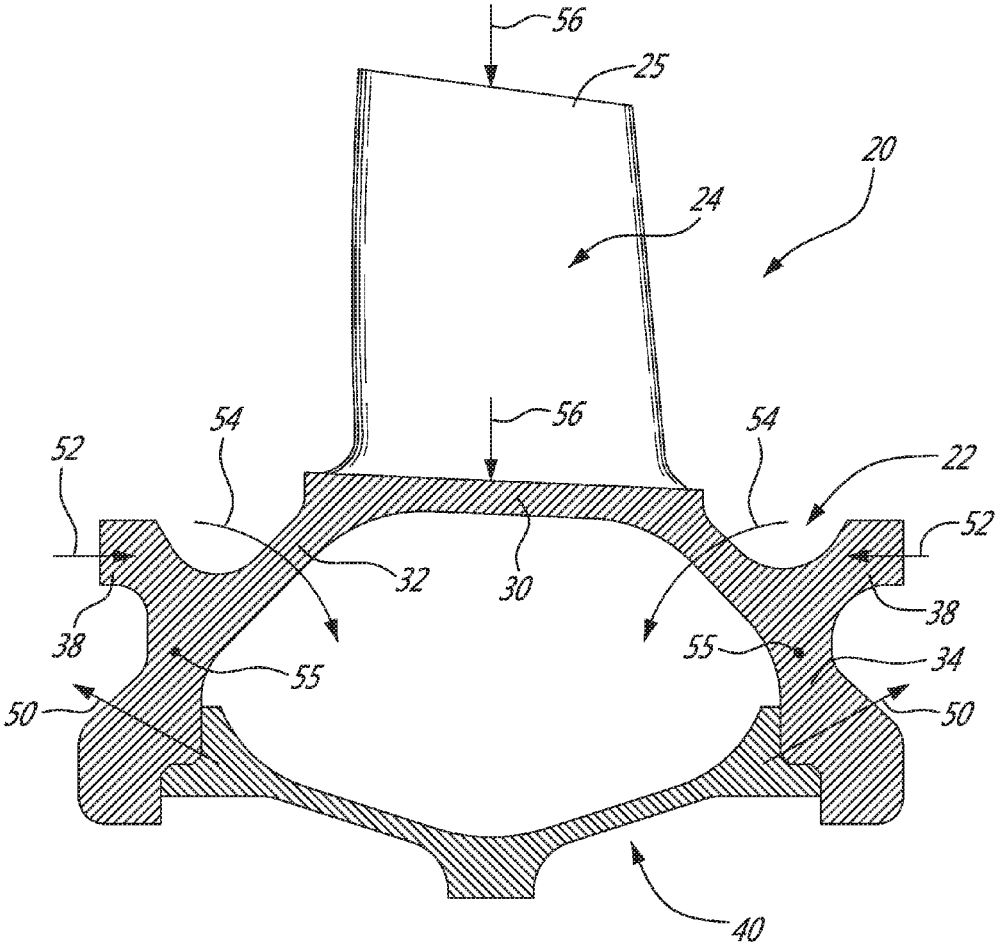
FIG. 5 is a cross-sectional view of the rotor of FIG. 2, showing load forces applied to the rotor hub by the loading plate.

Referring to FIGS. 4 and 5, the hub 22 of the IBR 20 is formed having an annular outer rim 30, from which the blades 24 project, and a pair of opposed split hub members 31 which extend axially outward and radially inward from the rim 30 and define therebetween a radially inward opening annular cavity 28. These split hub members 31 include angled flex arms 32 and more radially extending moment flanges 34 which are integrally formed with the flex arms 32 to define the split hub members 31. Unlike typical IBRs, therefore, the annular hub 22 of the IBR 20 is hollow in that it has a radially inward opening cavity 28 which extends annularly and uninterrupted about the full circumference of the hub 22 and is defined within the hub 22 by the rim 30 and the flex arms 32 and moment flanges 34 of the split hub members 31. The radially inner edge of the moment flanges 34 defines the central bore 36 of the hub 22, and therefore of the entire IBR 20, within which an engine shaft is received when the IBR 20 is mounted within the compressor 14 of the gas turbine engine 10.

Within the annular cavity 28 of the hub 22 is disposed at least three loading plates 40, which are separately formed from the monolithic construction of the remainder of the IBR 20. Each of the loading plates 40 axially extends between the opposed moment flanges 34 of the split hub members 31, and is axially tightly fitted therebetween. The loading pate 40 is circumferentially arcuate in that it extends in a circumferential direction a portion of the full circumference of the annular cavity 28. At least three of these loading plates 40 are provided within the annular cavity 28, as best seen in FIG. 3 for example, the three or more of these loading plates 40 being circumferentially equally spaced apart therearound. While more than three (such as four for example) loading plates 40 may be used, they should be circumferentially spaced apart from each other at least enough that they do not circumferentially touch during operation, in order to avoid a build up of hoop stress therein.

As best seen in the cross-sectional views of FIGS. 4 and 5, each loading plate 40 has an axial curvature therein which defines a radially inwardly convex shape (i.e. it is convex in a direction away from the cavity 28 and the rim 30 of the hub 22, such as to create a spring-like effect against the split hub members 31 with which the loading plate 40 is in contact at both forward and aft axial ends of the hub 22.

Accordingly, referring to FIG. 5, the loading plate 40 acts on the two opposed moment flanges 34 of the split hub members 31 to induce an at least partially axially outward load 50 thereon, caused by a centripetal force generated by the loading plate 40 as the hub 22 rotates. As seen in FIG. 4, this centripetal load force 50 applied by the loading plate 40 on the moment flanges 34 may in fact have both an axially outwardly directed component and a radially outward directed component. As the hub 22 rotates, opposed and axially inwardly directed force 52 are also applied on the axially outer spigots 38 of the hub 22 as a result of loads imposed by tie-shafts on either side of the IBR 20 and to which the IBR 20 is mounted within the gas turbine engine.

Therefore, as the IBR 20 rotates during operation, the combined loading of the axially inward tie-shaft forces 52 and the axially outward centripetal forces 50 imposed on the moment flanges 34 of the hub 22 induce an inward bending moment 54 on the flex arms 32. These two opposed and equal inward bending moments 54 induced on each of the opposed flex arms 32, substantially around opposed moment centers 55 in each of the split hub members 31, combine to induce a radially inward deflection 56 on the rim 30 and thus on the blades 24 radially projecting therefrom. Accordingly, this radially inward deflection 56 acts to deflect the blades 24 inward, thereby opposing the normal outward centripetal growth normally seen in the blades of a conventional IBR. This radially inward deflection 56 of the blades 24, and thus the blade tips 25, accordingly helps maintain a reduce blade tip clearance between the blade tips 25 and the surrounding shroud or compressor casing within which the IBR 20 rotates. This is achieved without using traditional bore mass to reduce blade tip clearance. Because the inward bending moment 54 is governed by the outward centripetal force 50 reaction of the loading plate 40, an increase in rotational speed of the IBR 20 will result in greater inward deflection 56 of the blades 24.

Accordingly, using the above-described configuration of the loading plates 40 and the hub 22 of the IBR 20, the amount of blade tip deflection produced is lower than for conventional IBRs having a solid hub and no such loading plates 40. Further, the present configuration can also enable the precise amount of blade tip deflections to be accurately controlled, and this can be modified if required by varying the properties of the loading plates 40 (for example, by making them stiffer or less stiff by modifying their shape, thickness, material, axial fits with the hub, etc.

The IBR 20 of the present disclosure thereby enables rotor tip clearances to be reduced, and controlled, by limiting radially inward deflection of the rotor blade tips, thereby improving overall compressor efficiency.

The above description is meant to be exemplary only, and one skilled in the art will recognize that changes may be made to the embodiments described without departing from the scope of the concept disclosed. Still other modifications which fall within the scope of the concept will be apparent to those skilled in the art, in light of a review of this disclosure, and such modifications are intended to fall within the appended claims.

The invention claimed is:

1. An integrally bladed rotor for a gas turbine engine comprising:

a hub defining a central axis of rotation about which the rotor is rotatable;

a plurality of blades radially extending from the hub and being integrally formed therewith to define the integrally bladed rotor, the blades being adapted to project into an annular gas flow passage of said gas turbine engine;

the hub having a rim from which said blades radially project and a pair of axially opposed split hub members extending at least radially inward from said rim, each of the split hub members having a radially outer flex arm portion extending form the hub and a radially inner moment flange portion integrally formed with the flex arm portion, a radial inner edge of the moment flange portions defining a central bore of the rotor; and at least one moment inducing element separately formed from the hub and mounted axially between the opposed split hub members, the moment inducing element acting on the moment flange portions of the opposed split hub members to generate an inward bending moment on the flex arm portions of the opposed split hub members during rotation of the rotor, thereby deflecting the rim and the blades of the rotor radially inwardly.

2. The rotor as defined in claim 1, wherein the amount of radially inward blade deflection generated by the moment inducing element increases as the rotational speed of the rotor increases.

3. The rotor as defined in claim 1, wherein the moment inducing element includes at least three loading plates axially extending between the moment flange portions of the opposed split hub member in axial tight fit engagement therewith.

4. The rotor as defined in claim 3, wherein each of the loading plates having an axial curvature defining a radially inwardly convex shape.

5. The rotor as defined in claim 3, wherein the loading plates are arcuate and circumferentially spaced apart.

6. The rotor as defined in claim 1, wherein the split hub members and the rim define therebetween a radially inward opening annular cavity within the hub.

7. The rotor as defined in claim 6, wherein the at least one moment inducing element is disposed substantially within the annular cavity of the hub.

8. The rotor as defined in claim 1, wherein the rotor is an axial compressor rotor.

9. The rotor as defined in claim 1, wherein each of said blades has a remote blade tip, the blade tips being adapted to be circumferentially surrounded by an outer shroud which encloses the annular gas flow passage, a radial tip clearance gap being defined between the blade tips and the outer shroud, wherein the moment inducing element counteracts centripetal forces on the rotor to minimize the tip clearance gap during operation of the gas turbine engine.

10. The rotor as defined in claim 1, wherein the opposed split hub members extend uninterrupted about a full circumference of the hub.

11. A gas turbine engine including a fan, a compressor section, a combustor and a turbine section in serial flow communication and each defining an annular gas flow passage, the gas turbine engine comprising:

at least one of the fan, the compressor section and the turbine section having at least one rotor, the rotor including a hub and a plurality of blades integrally formed therewith to define an integrally bladed rotor, the blades each extending radially outwardly from the hub to a remote blade tip and projecting into the annular gas flow passage of said at least one of the fan, the compressor section and the turbine section;

a shroud circumferentially surround the rotor and having a radially inner surface adjacent to the blade tips, a radial distance between the inner surface of the shroud and the blade tips defining a tip clearance gap of the rotor;

the hub of the rotor having a rim from which said blades radially project and a pair of axially opposed split hub members extending at least radially inward from said rim, each of the split hub members having a radially outer flex arm portion extending form the hub and a radially inner moment flange portion integrally formed with the flex arm portion, a radial inner edge of the moment flange portions defining a central bore of the rotor; and the rotor having at least one moment inducing element separately formed from the hub and mounted axially between the opposed split hub members, the moment inducing element acting on the moment flange portions of the opposed split hub members to generate an inward bending moment on the flex arm portions of the opposed split hub members during rotation of the rotor, thereby deflecting the rim and the blades of the rotor radially inwardly and minimizing the tip clearance gap between the blade tips and the shroud during operation of the gas turbine engine.

12. The gas turbine engine as defined in claim 11, wherein the amount of radially inward blade deflection generated by the moment inducing element increases as the rotational speed of the rotor increases.

13. The gas turbine engine as defined in claim 11, wherein the moment inducing element includes at least three loading plates axially extending between the moment flange portions of the opposed split hub member in axial tight fit engagement therewith.

14. The gas turbine engine as defined in claim 13, wherein each of the loading plates having an axial curvature defining a radially inwardly convex shape.

15. The gas turbine engine as defined in claim 13, wherein the loading plates are arcuate and circumferentially spaced apart.

16. The gas turbine engine as defined in claim 11, wherein the split hub members and the rim define therebetween a radially inward opening annular cavity within the hub.

17. The gas turbine engine as defined in claim 16, wherein the at least one moment inducing element is disposed substantially within the annular cavity of the hub.

18. The gas turbine engine as defined in claim 11, wherein the rotor is an axial compressor rotor.

19. The gas turbine engine as defined in claim 11, wherein the opposed split hub members extending uninterrupted about a full circumference of the hub.

20. A method of improving efficiency of a rotor for a gas turbine engine by minimizing a tip clearance gap between blade tips of the rotor and a surrounding outer shroud, the method comprising:

providing the rotor with a hub and a plurality of blades which are integrally formed therewith to form an integrally bladed rotor, the blades extending radially outwardly from the hub to the blade tips and projecting into an annular gas flow passage of said gas turbine engine, the hub of the rotor having a rim from which said blades project and a pair of axially opposed split hub members extending at least radially inward from said rim, each of the split hub members having a radially outer flex arm portion extending form the hub and a radially inner moment flange portion integrally formed with the flex arm portion; and inducing an inward bending moment on the flex arm portions of the split hub members to deflect the rim and the blades of the rotor radially inwardly, thereby minimizing the tip clearance gap between the blade tips and the shroud during operation of the gas turbine engine.

* * * * *